US007066101B2

(12) United States Patent
Codos

(10) Patent No.: US 7,066,101 B2
(45) Date of Patent: Jun. 27, 2006

(54) FLANGED PANEL FORMER

(75) Inventor: Richard N. Codos, Warren, NJ (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/502,916

(22) PCT Filed: Jul. 2, 2002

(86) PCT No.: PCT/US02/21094

§ 371 (c)(1),
(2), (4) Date: Jul. 28, 2004

(87) PCT Pub. No.: WO03/004792

PCT Pub. Date: Jan. 16, 2003

(65) Prior Publication Data

US 2005/0034642 A1 Feb. 17, 2005

Related U.S. Application Data

(60) Provisional application No. 60/302,881, filed on Jul. 3, 2001.

(51) Int. Cl.
*D05B 11/00* (2006.01)

(52) U.S. Cl. ..... 112/117

(58) Field of Classification Search ..... 112/117–119, 112/130, 401, 402, 423, 440, 412, 2.1, 470.12, 112/470.13, 475.08; 700/136, 138
See application file for complete search history.

(56) References Cited

U.S. PATENT DOCUMENTS 5,544,599 A * 8/1996 Frazer et al. ..... 112/118
5,943,971 A * 8/1999 Trickett et al. ..... 112/2.1
6,000,352 A * 12/1999 Porter et al. ..... 112/470.12
6,408,773 B1 * 6/2002 Resta ..... 112/2.1

* cited by examiner

*Primary Examiner*—John J. Calvert
*Assistant Examiner*—Brian Kauffman
(74) *Attorney, Agent, or Firm*—Wood Herron & Evans, LLP

(57) ABSTRACT

An apparatus for forming flanged quilted panels from an infed web of quilted material (18) has a panel cutter (14) which receives the web of quilted material (18) and severs it into discrete quilted panels (16). A flanger (34) integrated with the panel cutter (14) has a table (40) which supports individual panels in a fixed position while a trimming and sewing head (60) is moved around the perimeter of the panel to trim the panel to a desired size and to stitch a flange near the trimmed edge. Because the panel is trimmed prior to stitching, precise alignment of the panel on the table is not required. The flanger (34) may further include a cutting head (72) which is movable relative to the table (40) and enables the flanger (34) to cut very thick quilted material without the need for precise holding and guiding of the material.

21 Claims, 2 Drawing Sheets

FLANGED PANEL FORMER

This application is a U.S. National Stage application of International Patent Application No. PCT /US02/21094, filed on Jul. 2, 2002, which claims the benefit of U.S. Provisional Patent Application Ser. No. 60/302,881, filed on Jul 3, 2001, each of which is hereby incorporated herein by reference in its entirety

FIELD OF THE INVENTION

This invention relates to the flanging of mattress cover panels, and more particularly, to the integration of flanging devices into quilted mattress cover panel making equipment.

BACKGROUND OF THE INVENTION

Mattress cover top and bottom panels are formed on quilting machines, usually from continuous webs of multi-layered material, and then cut into rectangular panels. The cutting is carried out by feeding the quilted web to a panel cutter that is typically located on the quilting line downstream of the quilting station so that the quilted web need not be rerolled and transferred to the cutting equipment. The top and bottom panels are then sewn around their edges to border panels to form a mattress cover that encloses a spring or foam interior.

In order to keep the mattress cover from shifting about the mattress interior, a flange of fabric, usually a non-woven material, is sewn on the back surface of each top and bottom panel, typically around the inside of the edge, thereby leaving the edge free to be sewn to the border panel using tape edge attaching equipment. Upon assembly of the mattress, the flanges on the top and bottom panels are clipped or otherwise attached to the sides of the spring or foam interior to hold them in place relative to the interior. Then the border panel is attached around the edge of the mattress by sewing it at its opposite edges to the edges of the top and bottom panels that have been attached to the mattress interior.

Typically, the sewing of the flange onto the panel is carried out with a device that may be called a flanger. The panels cut from the web by the panel cutter are usually transferred to the flanger for the attaching of the flange. This flanging process consumes production time and adds to the mattress cost.

A need exists for a more efficient method and apparatus for attaching a flange to a mattress cover panel.

SUMMARY OF THE INVENTION

The invention provides the integration of a mattress panel flanging device into a quilting panel cutter. Essentially an untrimmed quilted top or bottom mattress cover panel is fed to the panel cutter. The panel cutter, which includes a flange applying and edge cutting and sewing device, moves across the panel.

In the preferred embodiment, a gantry on the panel cutter moves via two linear motors in a first direction, which is the longitudinal direction in which the panel is fed into the panel cutter. A sewing device is moveable on the gantry to move along the gantry in a second, transverse direction, also via linear motor drive. The linear motors may be, for example, linear servo motors. The sewing device can preferably be moved to any point within this panel envelope. Furthermore, the sewing device is mounted on a carriage, that is transversely moveable on the gantry, and is rotatable on the carriage, via a servomotor, around its own axis. An edge trimming element is also provided in the carriage which trims the edges of the panel as the flange is being sewn, preferably immediately ahead of the sewing device. The extent of this rotational movement can be restricted to 360 degrees plus 90 degrees, to simplify the wiring /IO to the sewing machine and its motor. This rotational limitation allows the head to follow the 360-degree contour of a panel, and once the panel is finished, to rotate back to its starting position, avoiding the need to use a rotational slip ring, which is both cumbersome and difficult to implement. Rotation of as little as 270° can be sufficient for the stitching of a simple rectangular panel, but 360° to 450° of rotational motion is preferred.

On prior art flanging equipment, the head is held stationary and the panel is rotated to always feed normal to the direction of sewing. With the present invention, by keeping the panel stationary and rotating the sewing head, the flanging process is more easily automated. Preferably, some securements are provided that function to clamp the panel to a support table or conveyor.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
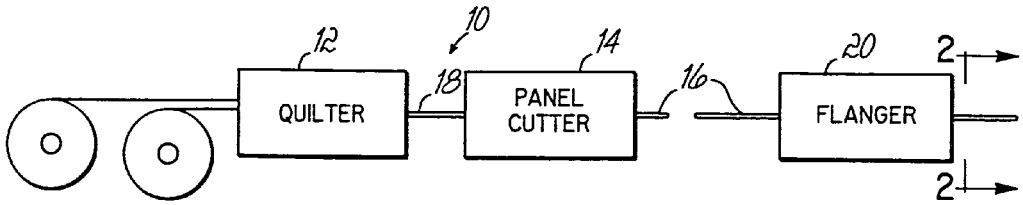
PRIOR ART FIG. 1
FIG. 1 is a schematic drawing depicting a typical prior art quilting line.
Figure 2:
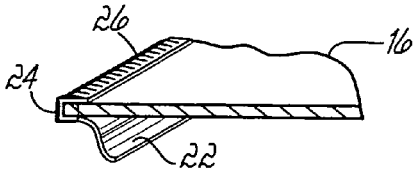
FIG. 2 is a partial cross-sectional view taken along line 2—2 of FIG. 1 depicting a quilted panel with a flange sewn to an outer edge.

Mattress panel quilting lines having panel cutters integrated therewith are described in U.S. Pat. Nos. 5,544,599 and 6,237,517,herein expressly incorporated by reference in their entirety. The features of a typical prior art panel quilting line 10 are schematically represented in FIG. 1. With reference to FIGS. 1–2, the line 10 includes a quilter 12 and a panel cutter 14 located downstream of the quilter 12. The panel cutter 14 is controlled to transversely cut quilted panels 16 from a quilted web 18 that emerges from the quilter 12 and is fed to panel cutter 14. In the prior art systems, panel 16 is typically transferred to a separate flanger 20 where a flange 22 of fabric may be sewn around the perimeter of the panel 16 by rotating the panel 16 and guiding its side edges 24 beneath a fixed sewing head (not shown).

Figure 3:
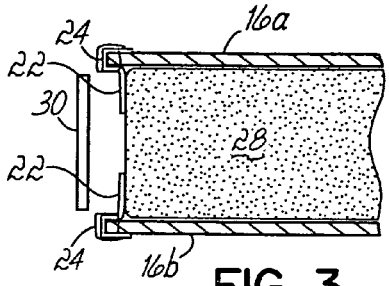
FIG. 3 is a partial cross-section view depicting a mattress assembly construction, including quilted panels.

A partial section view of panel 16 having a flange 22 attached to a side edge 24 by an overlock stitch 26 is shown in FIG. 2. During the manufacture of a mattress, the flange 22 helps to center a top panel 16*a* and a bottom panel 16*b* on a mattress assembly 28 and prevents shifting of the panels 16*a*, 16*b* on the mattress assembly 28 while a border panel 30 is sewed between the outwardly extending edges 24 of the panels 16*a*, 16*b*, as depicted in FIG. 3.

Figure 4:
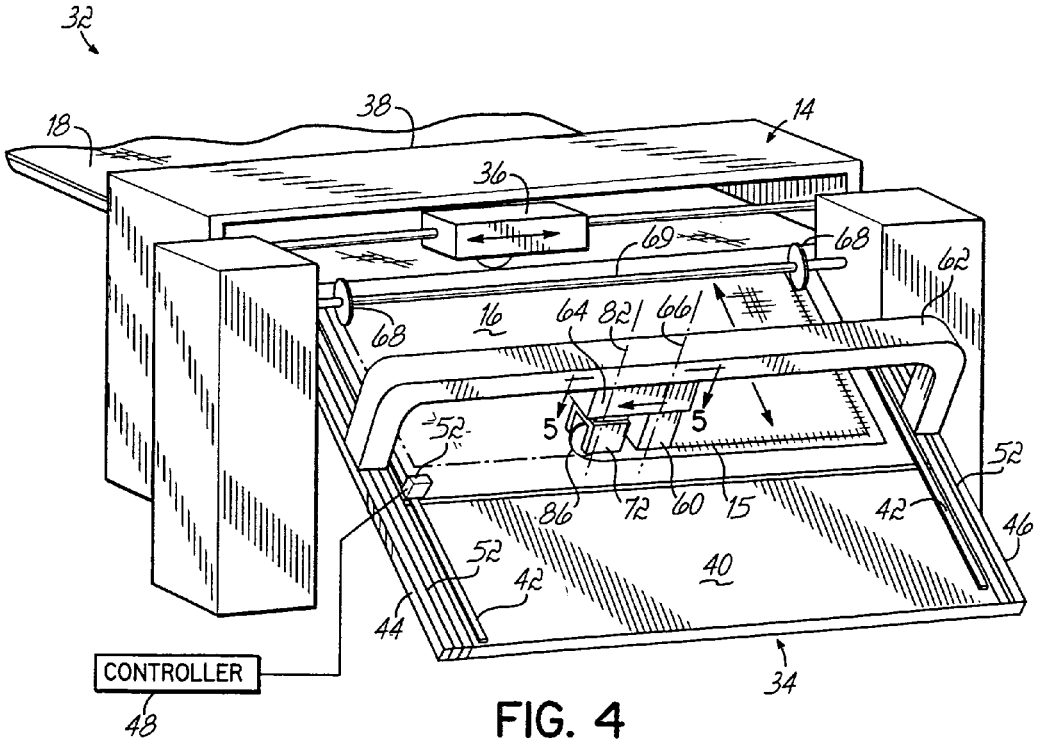
FIG. 4 is a perspective view of an exemplary flanged panel former of the present invention.

Referring now to FIG. 4, there is shown an exemplary flanged panel former 32 of the present invention, including a panel cutter 14 and an exemplary flanger 34 adjacent an output end of the panel cutter 14. The flanged panel former 32 may be positioned downstream of a quilter 12 to receive a quilted web 18, as described above. Panel cutter 14 includes a cutting mechanism 36 which is transversely moveable across a frame 38 of the panel cutter 14 to sever the quilted panels 16 from the web 18. The exemplary flanger 34 includes an inclined table 40 fixed to an output end of frame 38, to receive panels 16 from the panel cutter 14. Each infed panel 16 may be clamped to table 40 by pneumatically actuated edge securements 42 disposed on opposite lateral sides 44, 46 of table 40. The edge securements 42 may be actuated to clamp the panel 16 by a controller 48 in response to signals from panel presence sensors 50 on the table 40.

The flanger 34 has longitudinal tracks 52 disposed on opposite sides 44, 46 of table 40 and extending in a direction parallel to the panel feed direction, indicated by arrow 54 in FIG. 4. A trimming and sewing head 60 is suspended above the table 40 by a gantry 62 which extends transversely across the width of the table 40. The trimming and sewing head 60 is coupled to the gantry 62 by a carriage 64 which may be driven by a servo motor (not shown) to move along the length of the gantry 62 in a direction perpendicular to the feed direction 54. In the exemplary flanger 34 shown, trimming and sewing head 60 includes a stitching element 60*a*, as more clearly shown in FIG. 5. The gantry 62 is mounted to the longitudinal tracks 52 and is driven by a motor (not shown) to move along the tracks 52 in a direction parallel to the panel feed direction 54. The trimming and sewing head 60 is rotatably mounted to the carriage 64 and is driven by a servo motor (not shown) to rotate about an axis 66 normal to the plane of table 40. In an exemplary embodiment, the trimming and sewing head 60 may be configured to rotate about axis 66 through an angle of about 450°.

The movements and operation of the trimming and sewing head 60, the carriage 64, and the gantry 62 are coordinated by a controller 70 which is coupled to respective servo motors which drive these components. Accordingly, the trimming and sewing head 60 may be controlled to move in a rectangular path over the table 40 to thereby trim the discarded edges 65 from panel 16 and to simultaneously stitch a flange 22 to the underside of the panel 16. The flanger 34 may further include rollers 68 disposed along opposite sides 44, 46 of table 40 and rotatably supported on a transversely extending shaft 59 to guide and secure the side edges of panel 16 as the flange 22 is applied.

Figure 5:
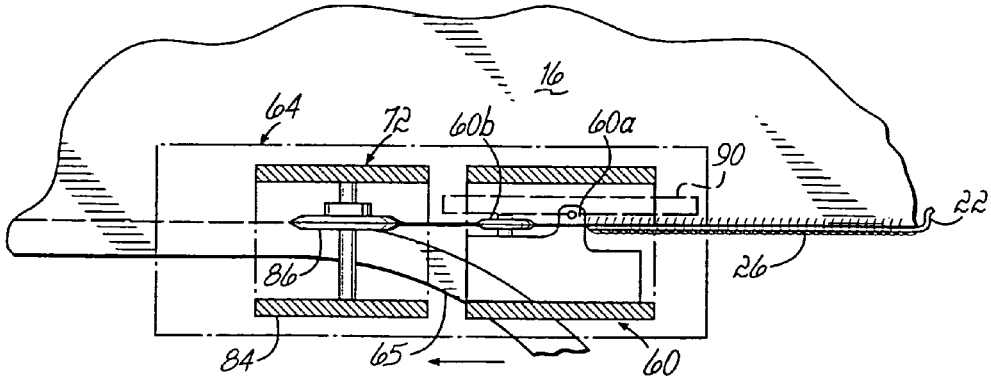
FIG. 5 is a partial section view taken along line 5—5 of FIG. 4.
Figure 6:
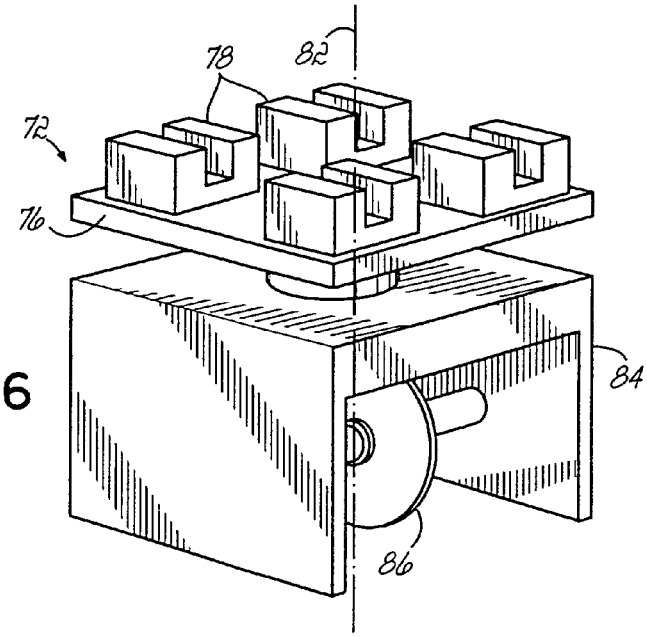
FIG. 6 is a perspective view depicting detail of the exemplary cutting head.

In the exemplary embodiment shown in FIGS. 4–6, panel cutting mechanism 36 severs the infed web 18 to create individual panels 16 and a trimming element 60*b* of the trimming and sewing head 60 trims the panel 16 to a desired size just ahead of the stitching element 60*a* of the trimming and sewing head 60, whereby precise alignment of the panel 16 on table 40 is not required to ensure a precise stitch line 26. Alternatively, the function of the cutting mechanism 36 and the trimming element 60*b* of the trimming and sewing head 60 may be combined into a single cutting device thereby eliminating the need for a separate cutting mechanism 36 to sever the infed web 18 into individual panels 16. In this embodiment, a cutting head 72 may be rotatably coupled to carriage 64 and positioned ahead of the trimming and sewing head 60 to cut the panel 16 from the continuous web 18 of quilted material and trim the discarded edge 65, while the stitching element 60*a* of the trimming and sewing head 60 follows immediately behind to stitch the flange 22 to the edge 24 of panel 16. This arrangement facilitates efficient winding up of scrap material for easy and clean recycling or disposal, and at the same time makes controlling the quilted material substantially easier, for example, by eliminating the need for precise material edge control for forming the stitch 26.

Figure 5A:
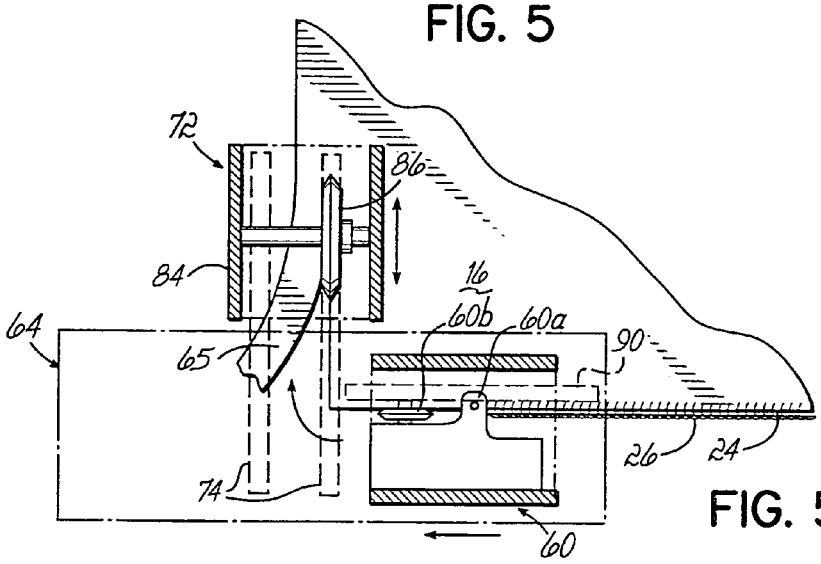
FIG. 5A is a partial section view similar to FIG. 5, depicting a cutting head of the flanged panel former negotiating a corner of a panel.

In another exemplary embodiment depicted in FIG. 5A, the cutting head 72 may be configured to move independently of the trimming and sewing head 60 whereby the cutting head 72 may rotate and translate relative to the carriage 64, enabling the cutting head 72 to move around corners of the panel 16 ahead of the trimming and sewing head 60.

As shown more clearly in FIGS. 5A and 6, carriage 64 may include guide rails 74 extending outwardly in a direction parallel to the panel feed direction 54. Cutting head 72 may be coupled to a support plate 76 having channel sections 78 configured to engage guide rails 74 whereby the cutter head 72 may be driven along guide rails 74 by a motor (not shown) while simultaneously pivoting about an axis 82 normal to the plane of table 40. Accordingly, cutter head 72 is independently maneuverable along guide rails 74, with respect to the movement of the carriage 64, so that the cutter head 72 may negotiate a corner formed by adjacent side edges 24 of panel 16, ahead of trimming and sewing head 60. As shown most clearly in FIG. 6, cutting head 72 may further include a housing 82 with spaced sidewalls 84 which serve as a guard for cutting blade 86 and help to hold down the panel 16 while cutting.

In another exemplary embodiment, the flanger 34 may include both a cutting head 72 and a trimming and sewing head 60 having a trimming element 60*b* positioned ahead of the stitching element 60*a* to trim the panel edge immediately outside of the overlock stitching 26. Such an arrangement permits the flanger 34 to be used with very thick quilting materials whereby the cutting head 72 may be configured to rough cut through the thick quilted material and trimming element 60*b* performs a secondary trim, thereby eliminating the need for accurate holding and guiding of the edge of the material. To further facilitate holding the quilted panel 16 in place and to ensure that the trimming and sewing head 60 is correctly positioned relative to the edge formed by cutting head 72, the flanger 34 may be provided with a tractor feed 90 adjacent the stitching element 60*a*.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. A quilted panel forming apparatus comprising:

a quilting station for forming a web of quilted material;

a panel cutter downstream of the quilting station for cutting discrete panels from said web;

a table downstream of said panel cutter for receiving and supporting a panel cut from the web; and a stitching member supported above said table and movable relative to said table along an outer periphery of the quilted panel supported on said table to thereby stitch the flange proximate the outer edge of the panel.

2. The apparatus of claim 1, further comprising:

a trimming member supported above said table and adjacent said stitching member, said trimming member movable relative to said table to access the outer periphery of the quilted panel supported on said table to thereby trim the outer edge of the panel.

3. The apparatus of claim 1, wherein said trimming member and said stitching member are supported on a gantry which extends above and across said table and is movable along a direction parallel to the plane of said table to thereby position said stitching member and said trimming member at a desired location relative to the panel supported on said table.

4. The apparatus of claim 3, wherein said stitching member and said trimming member are supported on said gantry for rotational movement about an axis normal to said table.

5. An apparatus for applying a flange to the outer edge of a quilted panel received from a quilting line, comprising:

a table downstream of the quilting line for receiving and supporting a panel from the quilting line; and a stitching member supported above said table and movable relative to said table along an outer periphery of the quilted panel supported on said table to thereby stitch the flange proximate the outer edge of the panel.

6. The apparatus of claim 5, further comprising:

a trimming member supported above said table and adjacent said stitching member, said trimming member movable relative to said table to access the outer periphery of the quilted panel supported on said table to thereby trim the outer edge of the panel.

7. The apparatus of claim 5, wherein said trimming member and said stitching member are supported on a gantry which extends above and across said table and is movable along a direction parallel to the plane of said table to thereby position said stitching member and said trimming member at a desired location relative to the panel supported on said table.

8. The apparatus of claim 7, wherein said stitching member and said trimming member are supported on said gantry for rotational movement about an axis normal to said table.

9. An apparatus for forming a quilted panel and applying a flange to the outer edge of the quilted panel received from a quilting line, comprising:

a table for receiving and supporting an infed web of quilted material; and a cutting member supported above said table and movable relative to said table to cut the infed web into a desired panel shape;

a stitching member supported above said table, adjacent said cutting member, said stitching member movable relative to said table along an outer periphery of the quilted panel formed by said cutting member to thereby stitch the flange proximate the outer edge of the panel.

10. The apparatus of claim 9, further comprising a trimming member supported above said table adjacent said stitching member, said trimming member movable relative to said table to access an outer periphery of the quilted panel formed by said cutting member and thereby trim the outer edge of the panel.

11. The apparatus of claim 9, wherein said cutting member and said stitching member are supported on a gantry which extends above and across said table and is movable along a direction parallel to the plane of said table to thereby position said cutting member and said stitching member at a desired location relative to said table.

12. An apparatus for forming a flanged quilted panel, comprising:

a panel cutter adapted to receive an infed web of quilted material and having a cutting element adapted to cut a discrete quilted panel from the web;

the panel cutter having a table downstream of said panel cutter for receiving and supporting the quilted panel; and a stitching member supported above said table and movable relative to said table along an outer periphery of the quilted panel supported on said table to thereby stitch the flange proximate the outer edge of the panel.

13. The apparatus of claim 12, further comprising a trimming member supported above said table adjacent said stitching member, said trimming member movable relative to said table to access an outer periphery of the quilted panel and thereby trim the outer edge of the panel.

14. The apparatus of claim 13 further comprising:

a trimming and stitching head movable relative to said table around the outer periphery of a panel supported on the table;

the stitching member and the trimming member being carried by the head.

15. A quilting machine comprising the apparatus of claim 12; and a quilting station for quilting a web of quilted material and adapted to feed the web to said apparatus.

16. A method of forming a flanged quilted panel, comprising:

receiving an infed web of quilted material at a panel forming station;

severing from the infed web of quilted material a discrete quilted panel onto a table;

supporting a quilted panel in a fixed position on the table; and moving a stitching head along the outer perimeter the panel to attach a flange proximate outer edges of the panel.

17. The method of claim 16, further comprising:

moving a trimming element around an outer perimeter of the panel to trim the panel to a desired size.

18. The method of claim 17 wherein the trimming element is supplied on and movable with the stitching head; and the method includes moving the stitching head around the outer perimeter of the panel to both trim and attach the flange to the outer perimeter of the panel.

19. The method of claim 18 further comprising quilting a web of material and feeding the quilted web to the panel forming station.

20. The method of claim 17 further comprising quilting a web of material and feeding the quilted web to the panel forming station.

21. The method of claim 16 further comprising quilting a web of material and feeding the quilted web to the panel forming station.

* * * * *